United States Patent [19]

Tedder

[11] Patent Number: 4,724,693

[45] Date of Patent: Feb. 16, 1988

[54] TUBE EXPANSION TOOL

[75] Inventor: Joseph A. Tedder, Windsor, Conn.

[73] Assignee: Combustion Engineering, Inc., Windsor, Conn.

[21] Appl. No.: 811,484

[22] Filed: Dec. 20, 1985

[51] Int. Cl.[4] ..... B21D 39/20; B21D 26/02

[52] U.S. Cl. ..... 72/58; 29/421 R; 29/727

[58] Field of Search ..... 72/54, 56, 58; 29/727, 29/421 R, 523; 425/DIG. 19, 389

[56] References Cited

U.S. PATENT DOCUMENTS

| | | | |
|---|---|---|---|
| 3,287,947 | 11/1966 | Frantz et al. | 72/56 |
| 3,397,563 | 8/1968 | Pelton | 72/62 |
| 4,184,822 | 1/1980 | Schnabauer | 425/DIG. 19 |
| 4,195,390 | 1/1980 | Amen | 72/58 |
| 4,513,497 | 4/1985 | Finch | 72/58 |

FOREIGN PATENT DOCUMENTS

| | | | |
|---|---|---|---|
| 8944 | 3/1980 | European Pat. Off. | 72/58 |
| 1365999 | 6/1964 | France | 72/58 |
| 9653 | 3/1971 | Japan | 72/58 |

*Primary Examiner*—Robert L. Spruill
*Assistant Examiner*—David B. Jones
*Attorney, Agent, or Firm*—Chilton, Alix & Van Kirk

[57] ABSTRACT

A tube expansion tool for use in expanding sleeve inserts in the repair of steam generator tubes. An inflatable bladder radially enlarges in response to application of a pressurized fluid to radially expand a repair sleeve. The bladder is mounted to a mandrel by a pair of end caps which are configured to provide a fluid tight seal to confine the pressurized fluid inside of the bladder.

2 Claims, 2 Drawing Figures

TUBE EXPANSION TOOL

BACKGROUND OF THE INVENTION

1. Field of the Invention

This invention relates to a tool for expanding tubular members and particularly to a tool for expanding selected portions of tubes by hydraulic means. More specifically, the present invention is directed to a technique for the repair of steam generator tubes and especially to a method for securing repair sleeves within such tubes. Accordingly, the general objects of the present invention are to provide novel and improved apparatus and methods of such character.

2. Description of the Prior Art

A recurring problem in the power generation industry is the deterioration of steam generator tubes. Steam generator tube deterioration leads to the development of cracks and ultimately to leakage through the tube walls. The repair of deteriorated steam generator tubes conventionally involves installing a metal sleeve inside the deteriorated tube, the sleeve extending upstream and downstream at the leakage site. The tube/sleeve assembly is then radially expanded so that intimate surface-to-surface contact is established between the repair sleeve and the deteriorated tube. Various welding techniques may then be employed to bond the deteriorated tube to the repair sleeve to enhance the tight fluid seal between the sleeve and the generator tube.

The expansion process conventionally involves the use of a hydraulic operating fluid, i.e., the interior of the sleeve is pressurized with the operating fluid to cause radial expansion thereof. A residue of the hydraulic fluid which contacts the sleeve may remain on the interior surface thereof after the expansion process is completed. This residual fluid may adversely affect the integrity of the welding which is subsequently undertaken to complete the tube/sleeve bonding process. The present invention is directed to a new and improved tube expansion method and tool which employs a hydraulic operating fluid and wherein fluid contact with the tube/sleeve assembly is avoided.

SUMMARY OF THE INVENTION

Briefly stated, the invention in a preferred form is a tube expansion tool which comprises an elongated mandrel. The mandrel has a generally cylindrical bladder mounting surface thereon and also has an interior operating fluid supply passage which communicates with a port at the mounting surface. An inflatable bladder encircles the mounting surface along an axially extending portion of the surface. The inflatable bladder has first and second axially spaced end sections. The end sections are secured to the mandrel by retainer members. The bladder end sections, the retainer members and the mandrel are fluidically sealed so that pressurized fluid exiting the port cannot escape into the sleeve or the tube being repaired. The operating fluid acts against the bladder to effect a radial expansion of the bladder and thus of the sleeve/tube assembly.

When it is in a non-inflated state, the bladder has a generally sleeve-like configuration with a constant inner diameter. The first and second end sections of the bladder have substantially uniform exterior diameters which are less than the exterior diameter of the bladder portion axially intermediate the end sections. The retainer members may comprise a pair of end caps which are mounted to the mandrel. Each end cap, in a preferred embodiment, has an axially projecting annular retention flange which extends over and thus captures a cooperating bladder end section for both radial and axial retention of the bladder end sections. The retention flanges of the end cap form an inner cylindrical surface which is sealingly engageable with the corresponding bladder end section. In one embodiment, a pair of axially spaced grooves are formed in the inner cylindrical surface of each end cap retention flange for receiving the expanded bladder end section to establish a fluid tight seal. An O-ring is interposed between the mandrel and each retainer member for sealing purposes.

An object of the invention is to provide a new and improved tube expansion technique and tool which may be employed for expanding a tube/repair sleeve assembly radially without the tube/sleeve assembly coming into contact with the operating fluid.

Another object of the invention is to provide a new and improved tube expansion tool which may be employed in an efficient manner whereby the tool may be easily inserted, operated and withdrawn from a tube/-repair sleeve assembly.

A further object of the invention is to provide a new and improved tube expansion tool of an efficient and durable construction.

Other objects and advantages of the invention will become apparent from the drawing and the specification.

BRIEF DESCRIPTION OF THE DRAWING

The present invention may be better understood, and its numerous objects and advantages will become apparent to those skilled in the art, by reference to the accompanying drawing wherein like reference numerals refer to like elements to the several figures and in which.

DETAILED DESCRIPTION OF THE INVENTION

Figure 2:
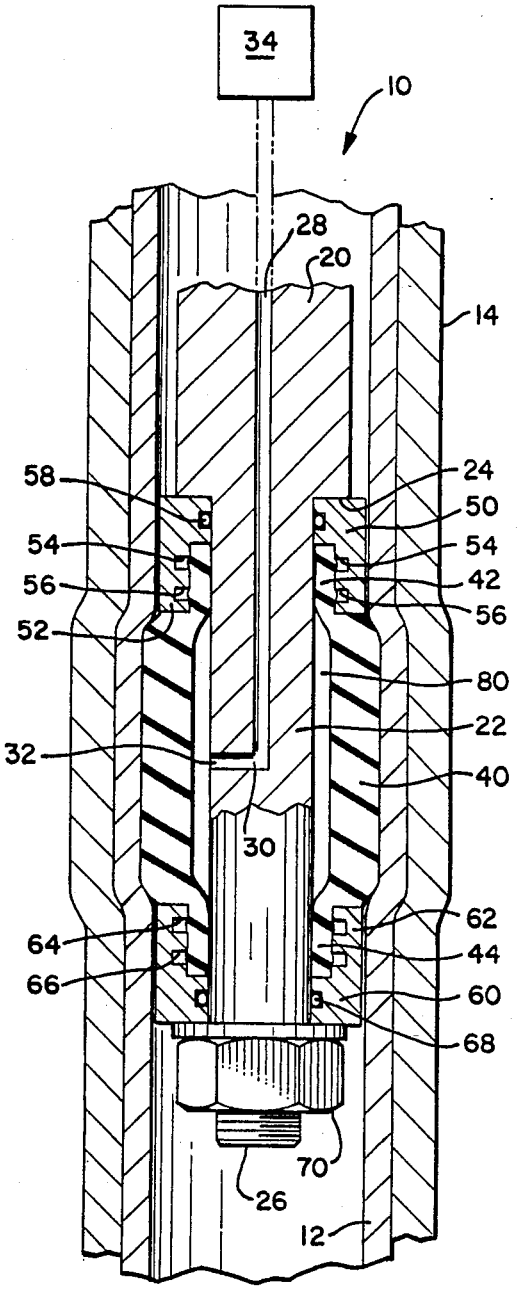
FIG. 2 is a fragmentary sectional view of the tube expansion tool of FIG. 1 and a tube/repair sleeve assembly illustrating the tool in an operative mode.

With reference to the drawing, a tube expansion tool in accordance with the present invention is generally designated by the numeral 10. Tube expansion tool 10 has numerous applications and is particularly well suited for use in the repair of deteriorated steam generator tubes. With reference to FIG. 2, tube expansion tool 10 is illustrated in an operative mode for radially expanding a metal repair sleeve 12 which has been inserted into a tube 14 to be repaired. The expansion tool 10 radially expands the repair sleeve 12 so that a portion of the exterior surface of the sleeve and a selected adjacent portion of the inside surface of the deteriorated tube 14 are brought into intimate surface-to-surface contact. The expanded portion of sleeve 12 extends upstream and downstream of the deteriorated region of the tube 14. Welding of sleeve 12 to tube 14 to enhance the fluid-tight seal therebetween may then be undertaken.

Figure 1:
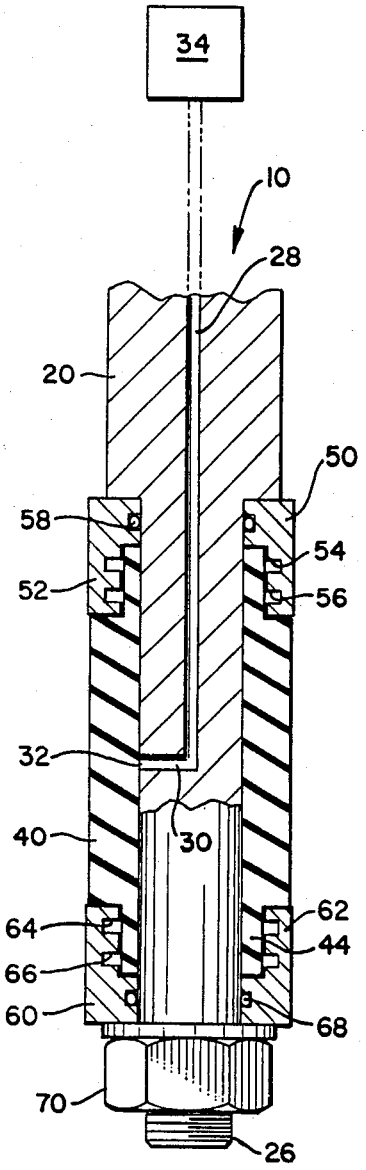
FIG. 1 is a fragmentary axial sectional view, partly broken away, partly in section and partly in schematic, illustrating a tube expansion tool in accordance with the present invention.

With reference to FIG. 1, expansion tool 10 comprises an elongated mandrel 20. A reduced diameter end portion of mandrel 20 forms a cylindrical mounting surface 22. Mounting surface 22 extends from a transverse shoulder 24 of the mandrel to a threaded end 26 of the mandrel. A fluid passage 28 extends axially through the mandrel and terminates at a radial passage 30. Passage 30 connects passage 28 to a discharge port 32 in the mounting surface 22. Axial passage 28 communicates via a suitable fluid conduit assembly (not illustrated) with a source of pressurized operating fluid designated generally by the number 34. The pressurized fluid may be selectively directed through the passages 28 and 30 for delivery to port 32 as hereinafter described.

Expansion means in the form of a resilient sleeve or inflatable bladder 40 is mounted on mandrel 20 so as to circumferentially extend around the cylindrical mounting surface 22 along a substantial axially extending portion of surface 22. In a mounted deflated state, bladder 40 has a sleeve-like configuration with a substantially constant inside diameter which is substantially commensurate with the outer diameter of mounting surface 22 as illustrated in FIG. 1. Bladder 40 is provided with opposing, axially spaced, end sections 42 and 44 which have a substantially uniform thickness which is less than the thickness of the portion of the bladder intermediate the end sections.

An inner end cap or first retainer 50 is slidably received on the mounting surface 22 and receives end section 42 of bladder 40 for securing one end of the bladder to the mandrel. End cap 50 includes an axially extending annular retention flange 52 which overlies bladder end sections 42 and in cooperation with the mandrel mounting surface 22 radially captures end section 42. The inner surface of annular flange 52 is by provided with a pair of parallel circumferentially extending grooves 54 and 56. The end of cap 50 axially opposite to flange 52 engages transverse mandrel shoulder 24. An O-ring 58 provides a fluid-tight seal between the end cap 50 and the mandrel mounting surface 22. The grooves 54 and 56 and the inner surface of the cap retention flange 52 cooperate to provide a fluid seal between the end section 42 of the bladder and end cap 50 when the bladder 40 is inflated as will be more fully described hereafter.

In like manner, an outer end cap or second retainer 60 is mounted on the mandrel 20 for securing bladder end section 44 to the mandrel. End cap 60 is substantially identical to end cap 50 and functions in substantially the same manner. Cap 60 includes a retention flange 62 and circumferentially extending grooves 64 and 66 formed in the inner surface of retention flange 62. An O-ring 68 is mounted in a groove on the end cap for fluidically sealing the end cap 60 to the mounting surface 22 of mandrel 20. A nut 70 engages the threaded end 26 of the mandrel and, via a washer, frictionally engages end cap 68. Nut 70, in cooperation with mandrel shoulder 24, axially clamps the end cap/bladder/end cap assembly to the mandrel.

The above-described bladder/end cap configuration functions to provide a fluid impervious seal between the bladder, and each of the end caps and the mandrel. Accordingly, as pressurized operating fluid exits port 32 and is forced between the inside surface of the inflatable bladder 40 and the mounting surface 22, the pressurized fluid is essentially confined between the bladder, the mandrel mounting surface and the end caps. As additional pressurized fluid is introduced into the region between the inflatable bladder and the mounting surface, the inflatable bladder expands radially relative to the mandrel so as to define a quasi-bulbous expansion chamber 80 between the bladder and the mandrel mounting surface as illustrated in FIG. 2. With further reference to FIG. 2, expansion tool 10 in a preferred application is employed for radially expanding a repair sleeve which is inserted into a steam generator tube to be repaired. The expansion tool is inserted into the repair sleeve and moved to a position wherein the bladder generally aligns with the deteriorated region of the tube 14. The expansion tool 10 is dimensioned to permit insertion into the repair sleeve when the bladder is in the deflated state.

The radial expansion forces exerted generated by the operating fluid are transferred to the inner surface of the repair sleeve 12 as illustrated in FIG. 2 to correspondingly produce a radial expansion of the repair sleeve 12. The repair sleeve is thus forced into intimate surface-to-surface contact with the adjacent inside surface of the tube to be repaired. A particular novel feature of the repair method of the present invention resides in the the provision of an effective fluid sealing structure which confines the operating fluid to the formed expansion chamber 80 and thus isolates the operating fluid from the repair sleeve. Thus, in accordance with the invention, the operating fluid does not come into contact with the repair sleeve or the sleeve/tube assembly. This is advantageous in that the structural integrity of any subsequent welding or bonding of the tube to the repair sleeve is not adversely effected by residual fluid or moisture remaining on the repair sleeve and/or repair sleeve/tube assembly.

Upon release of the hydraulic expansion pressure, the bladder essentially returns to its deflated state as illustrated in FIG. 1. Thus, the expansion tool can be easily withdrawn from the tube/sleeve repair assembly after causing the expansion of the assembly. The expansion tool may then be reused for implementing other repairs.

While a preferred embodiment of the invention has been set forth for purposes of illustration, the foregoing description should not be deemed a limitation of the invention herein. Acccordingly, various modifications, adaptations and alternatives may occur to one skilled in the art without departing from the spirit and scope of the present invention.

What is claimed is:

1. A tube expansion tool comprising:

an elongated mandrel said mandrel having an axis, a generally cylindrical body portion and a generally cylindrical exterior mounting surface of smaller diameter extending from the body portion and forming a shoulder therewith, said madrel further having an interior fluid supply passage which communicates with a discharge port at said mounting surface;

an inflatable bladder encircling a portion of said mounting surface, said bladder having first and second axially spaced end sections, said bladder in a non-inflated state having a generally sleeve-like configuration with the first and second end sections thereof having substantially onstant outer diameters which are less than the outer diameter of a bladder portion axially intermediate the end sections;

first retainer means abutting said shoulder and slidable on the mounting surface, for securing said bladder first end section to said mandrel;

first sealing means for establishing a seal between said first retainer means and said mandrel;

second retainer means spaced from the first retainer means and slidable on the mounting surface, for securing said bladder second end section to said mandrel;

second sealing means for establishing a seal between said second retainer means and said mandrel;

means for urging said second retainer means axially toward the first retainer means to effect the abutting of said first retainer means with said shoulder;

each of said first and second retainer means having an axially projecting annular retention flange, said flange capturing a cooperating bladder end section for radial retention thereof, said retention flange having an inner cylindrical surface engageable with said cooperating bladder end section, and, at least one annular groove being formed in said inner cylindrical surface for providing a seal between said bladder end section and said retainer means;

whereby pressurized fluid delivered to the interior of said mandrel via said supply passage will be captured between said mandrel mounting surface and said bladder and will exert pressure against said bladder to produce a radial expansion of the bladder.

2. The expansion tool of claim 1 wherein at least one said sealing means comprises an O-ring interposed between said mandrel and the cooperating retainer means.

* * * * *